US007361013B2

(12) United States Patent
Xu

(10) Patent No.: US 7,361,013 B2
(45) Date of Patent: Apr. 22, 2008

(54) NUMERAL LIGHTER

(75) Inventor: Wen Xu, El Monte, CA (US)

(73) Assignee: Zreative Product, Inc., El Monte, CA (US)

( * ) Notice: Subject to any disclaimer, the term of this patent is extended or adjusted under 35 U.S.C. 154(b) by 360 days.

(21) Appl. No.: 11/145,462

(22) Filed: Jun. 2, 2005

(65) Prior Publication Data

US 2006/0275722 A1 Dec. 7, 2006

(51) Int. Cl.
*F23D 11/36* (2006.01)
*F23Q 2/08* (2006.01)

(52) U.S. Cl. ..... 431/153; 431/132

(58) Field of Classification Search ..... 431/153, 431/254, 255, 132, 277, 344; D27/144, 148, D27/150, 161
See application file for complete search history.

(56) References Cited

U.S. PATENT DOCUMENTS 4,901,848 A * 2/1990 Parren ..... 206/86
5,171,143 A * 12/1992 Sohn ..... 431/153
D439,699 S * 3/2001 Xu ..... D27/161

* cited by examiner

*Primary Examiner*—Alfred Basichas
(74) *Attorney, Agent, or Firm*—Raymond Y. Chan; David and Raymond Patent Firm

(57) ABSTRACT

A numeral lighter includes an inner lighter housing having a liquefied gas storage and a top supporting frame and a numeral outer casing having a receiving cavity and a top opening communicating with the receiving cavity, wherein the inner lighter housing is detachably received in the receiving cavity of the numeral outer casing at a position that the liquefied gas storage is protectively enclosed within the numeral outer casing while the top supporting frame is positioned at the top opening of the numeral outer casing such that the numeral outer casing forms as an interchangeable shell to accommodate the inner lighter housing therein so as to enhance an aesthetic appearance of the lighter.

10 Claims, 4 Drawing Sheets

NUMERAL LIGHTER

BACKGROUND OF THE PRESENT INVENTION

1. Field of Invention

The present invention relates to a lighter, and more particularly to a numeral lighter which comprises a numeral outer casing detachably receiving an inner lighter housing such that the user is able to interchange the inner lighter housing with another numeral outer casing to enhance the aesthetic appearance of the lighter while being cost effective.

2. Description of Related Arts

A lighter is a common tool that replaces matches for igniting cigarettes and cigars. The advantages of the lighter are that the ignition operation of the lighter is simple and the lighter has a relatively compact size adapted to be carried in the user's pocket. Therefore, the user, especially the cigarette smoker, would like to carry the lighter as one of the accessories wherever he or she goes.

However, such lighter has several drawbacks. Most of the lighters are disposable that when the gas inside the lighter is used up, the lighter becomes one of trashes to be thrown away. Some lighters provide a refilling valve adapted to refill the gas for recycling use of the lighter. However, when the casing of the lighter is damaged accidentally or eventually worn out over a period of continuous use, the gas may start leaking from the lighter.

In addition, the ignition operation of the lighter is essentially the same, i.e. the user has to push an actuation button provided on the lighter casing to ignite the lighter. Because of the ease of this actuation procedure, very often, the lighters are unintentionally or accidentally ignited by, say, a child of the lighter owner. Therefore, handfuls of safety devices are developed to incorporate into the conventional lighters so as to prevent accidental or unintentional ignition, especially by minors who do have the capability to appreciate what might be a disastrous consequence of abusing the lighter. Those so called safety devices are founded on a general principle, that is, locking the depressive movement of the actuation button in order to prevent ignition, until the actuation button is manually unlocked, after which the lighter can then be normally ignited. As a matter of fact, the mechanism for locking the actuation buttons are indeed plentiful, most of which have achieved satisfactory outcome, at least in terms of preventing unintentional ignitions.

SUMMARY OF THE PRESENT INVENTION

A main object of the present invention is to provide a numeral lighter which comprises a numeral outer casing detachably receiving an inner lighter housing such that the user is able to interchange the inner lighter housing with another numeral outer casing to enhance the aesthetic appearance of the lighter while being cost effective.

Another object of the present invention is to provide a numeral lighter, wherein the numeral outer casing functions a protective shelter to enclose the inner lighter housing such that when the numeral outer casing is eventually worn out over a period of continuous use, the user is able to replace the numeral outer casing to protect the inner lighter housing so as to prolong the service life span of the lighter.

Another object of the present invention is to provide a numeral lighter, wherein the numeral outer casing has a blocking edge incorporating with the ignition button to block the ignition operation of the ignition button such that the numeral outer casing forms a safety device for preventing the lighter from being ignited accidentally or unintentionally.

Another object of the present invention is to provide a numeral lighter, which does not require to alter the original structural design of the lighter so as to minimize the manufacturing cost of the lighter incorporating with the numeral outer casing.

Another object of the present invention is to provide a numeral lighter, wherein no expensive or complicated mechanism is required to employ in the piezoelectric lighter, so that the present invention successfully provides an economic and efficient solution not only for interchanging the inner lighter housing with the numeral outer casing to facilitate the practical use of the lighter but also for providing a safety feature of the lighter.

Accordingly, in order to accomplish the above objects, the present invention provides a numeral lighter, comprising:

an inner lighter housing having a liquefied gas storage and comprising a top supporting frame;

a gas nozzle received in the inner lighter housing at the top supporting frame and communicating with the liquefied gas storage for controlling a flow of gas therefrom;

a piezoelectric unit, which is disposed in the inner lighter housing for generating piezoelectricity, comprising a movable operating part extended upwardly and an ignition tip extended to a position closed to the gas nozzle in such a manner that when the movable operating part is depressed downwardly, sparks are generated from the ignition tip to ignite the gas emitted from the gas nozzle;

an ignition unit slidably mounted to the top supporting frame of the inner lighter housing to depress the movable operating part of the piezoelectric unit and to release the gas from the liquefied gas storage at the same time; and a numeral outer casing having a receiving cavity and a top opening communicating with the receiving cavity, wherein the inner lighter housing is detachably received in the receiving cavity of the numeral outer casing at a position that the liquefied gas storage is protectively enclosed within the numeral outer casing while the top supporting frame is positioned at the top opening of the numeral outer casing such that the numeral outer casing forms as an interchangeable shell to accommodate the inner lighter housing therein so as to enhance an aesthetic appearance of the lighter.

These and other objectives, features, and advantages of the present invention will become apparent from the following detailed description, the accompanying drawings, and the appended claims.

DETAILED DESCRIPTION OF THE PREFERRED EMBODIMENT

Figure 1:
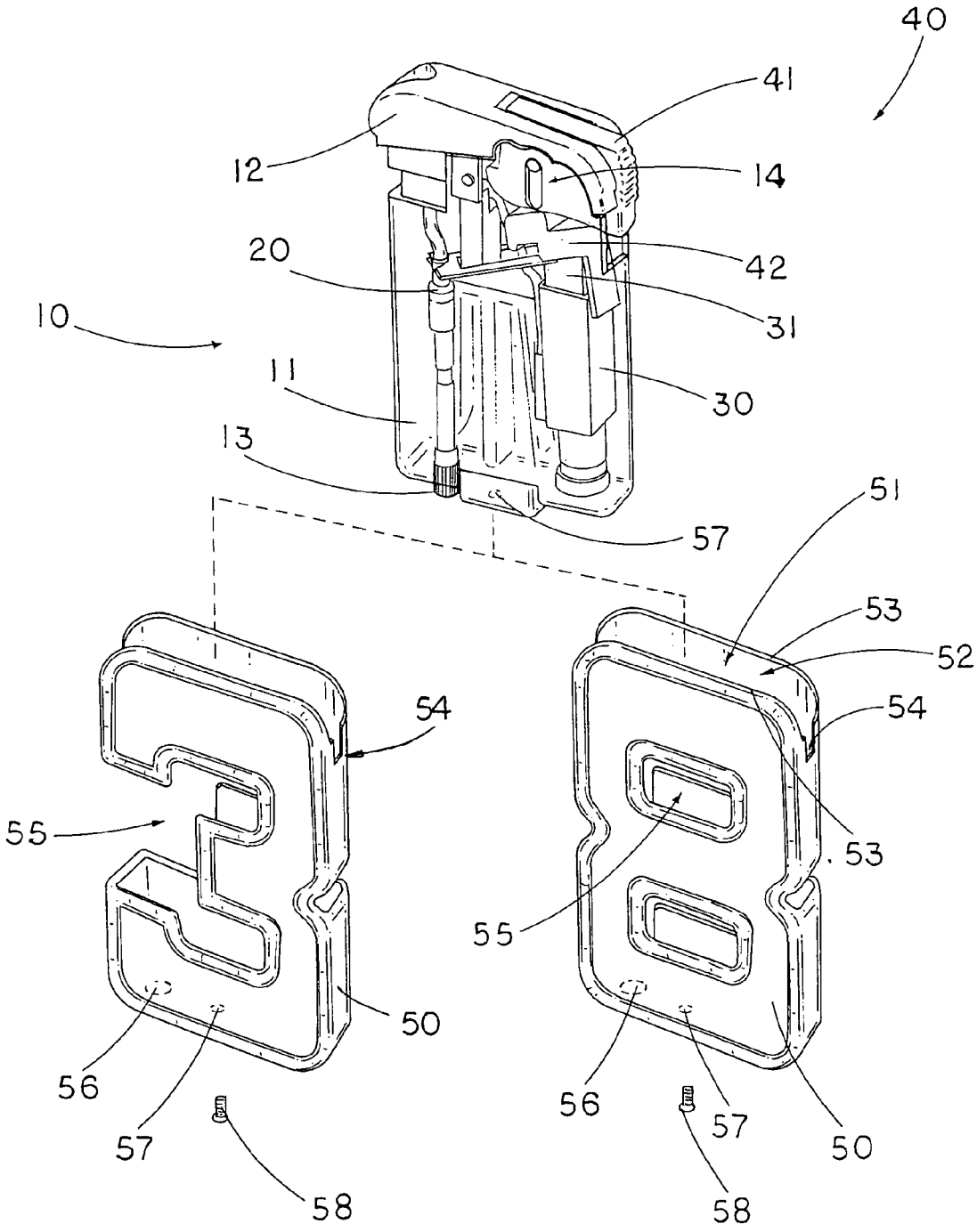
FIG. 1 is an exploded perspective view of a numeral lighter according to a preferred embodiment of the present invention.
Figure 2:
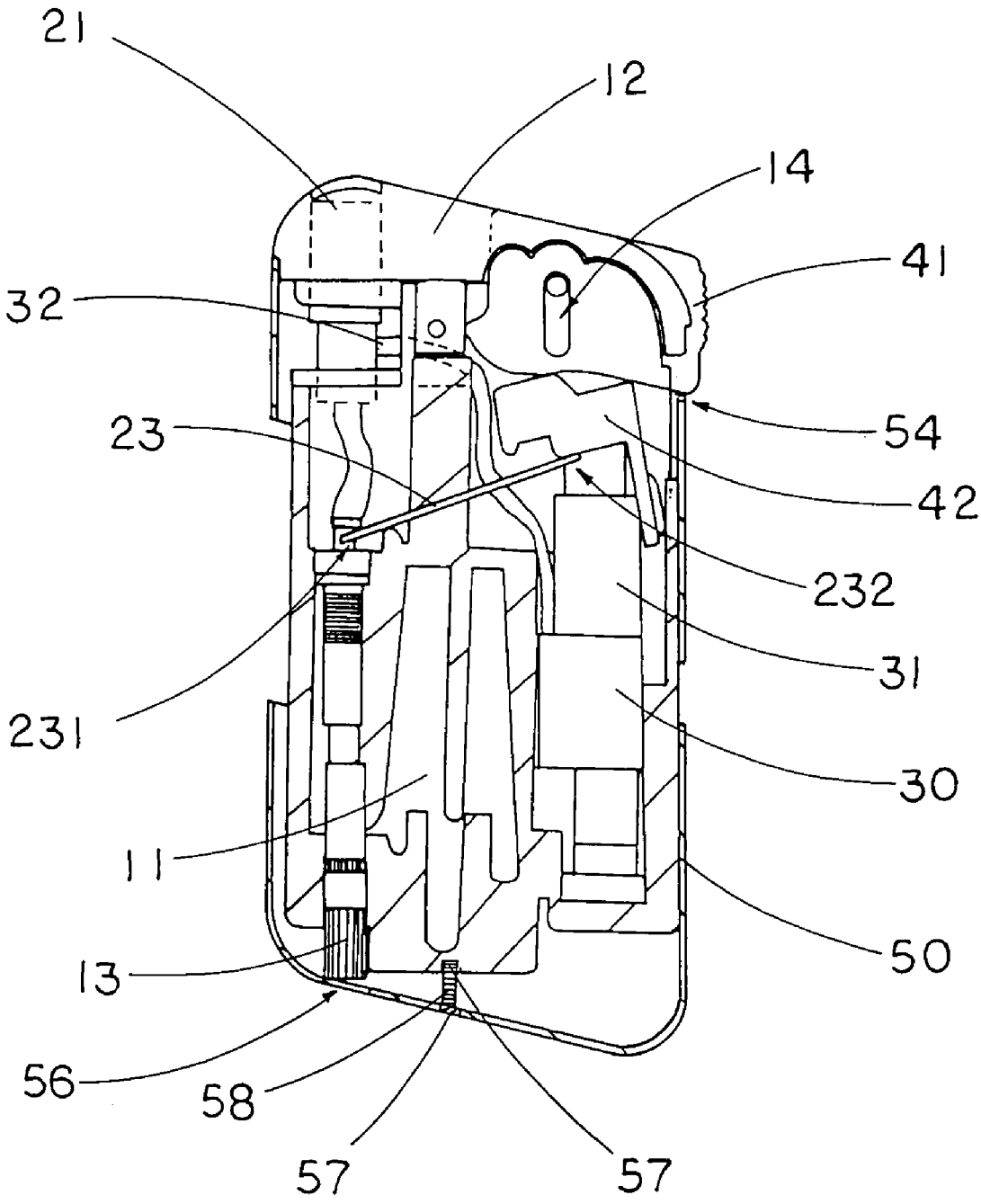
FIG. 2 is a sectional view of the numeral lighter according to the above preferred embodiment of the present invention.

Referring to FIGS. 1 and 2 of the drawings, a numeral lighter according to a preferred embodiment of the present invention is illustrated, wherein the numeral lighter comprises an inner lighter housing 10 having a liquefied gas storage 11 and comprising a top supporting frame 12, and a gas nozzle 20 received in the inner lighter housing 10 at the top supporting frame 12 and communicating with the liquefied gas storage 11 for controlling a flow of gas therefrom.

The inner lighter housing 10 further comprises a refilling valve 13 is formed at a bottom wall of the inner lighter housing 10 to communicate with the liquefied fuel storage 11 for refilling the gas thereto.

The numeral lighter further comprises a piezoelectric unit 30 disposed in the inner lighter housing 10 for generating piezoelectricity, and an ignition unit 40.

The piezoelectric unit 30 comprises a movable operating part 31 extended upwardly and an ignition tip 32 extended to a position closed to the gas nozzle 20 in such a manner that when the movable operating part 31 is depressed downwardly, sparks are generated from the ignition tip 32 to ignite the gas emitted from the gas nozzle 20.

The ignition unit 40 is slidably mounted to the top supporting frame 12 of the inner lighter housing 10 to depress the movable operating part 31 of the piezoelectric unit 30 and to release the gas from the liquefied gas storage 11 at the same time.

The numeral lighter further comprises a numeral outer casing 50 having a receiving cavity 51 and a top opening 52 communicating with the receiving cavity 51, wherein the inner lighter housing 10 is detachably received in the receiving cavity 51 of the numeral outer casing 50 at a position that the liquefied gas storage 11 is protectively enclosed within the numeral outer casing 50 while the top supporting frame 12 is positioned at the top opening 51 of the numeral outer casing 50 such that the numeral outer casing 50 forms as an interchangeable shell to accommodate the inner lighter housing 10 therein so as to enhance an aesthetic appearance of the lighter.

According to the preferred embodiment, the gas nozzle 20 comprises a nozzle head 21 supported at the top supporting frame 12 of the inner lighter casing 10, a gas releasable valve 22 coupling with the nozzle head 21 for controlling the gas flowing from the liquefied fuel storage 11 and a gas lever 23, which is disposed in the inner lighter casing 10 in a pivotal movable manner, having an engaging end 231 engaged with the gas releasable valve 22 and a depressible end 232 arranged in such a manner that when the depressible end 232 of the gas lever 23 is depressed downwardly, the engaging end 231 of the gas lever 23 lifts up the gas releasable valve 22 for releasing gas from the liquefied fuel storage 11.

The ignition unit 40 comprises an ignition button 41 slidably mounted on the inner lighter casing 10 at the top supporting frame 12 thereof and a depressing arm 42 supported in the inner lighter casing 10 to rest on top of the movable operating part 31 of the piezoelectric unit 30 and arranged in such a manner that when the ignition button 41 is depressed downwardly, the movable operating part 31 of the piezoelectric unit 30 and the depressible end 232 of the gas lever 23 are respectively depressed at the same time to generate the sparks and to release the gas so as to ignite the numeral lighter.

Accordingly, the ignition button 41 is pivotally mounted at the top supporting frame 12 between a folded position and an operation position, wherein at the folded position, the ignition button 41 is pivotally folded in the top supporting frame 12 to prevent the unintentional ignition of the numeral lighter, and at the operation position, the ignition button 41 is upwardly and pivotally folded from the top supporting frame 12 such that the ignition button 41 is adapted to be downwardly depressed for ignition.

Figure 3:
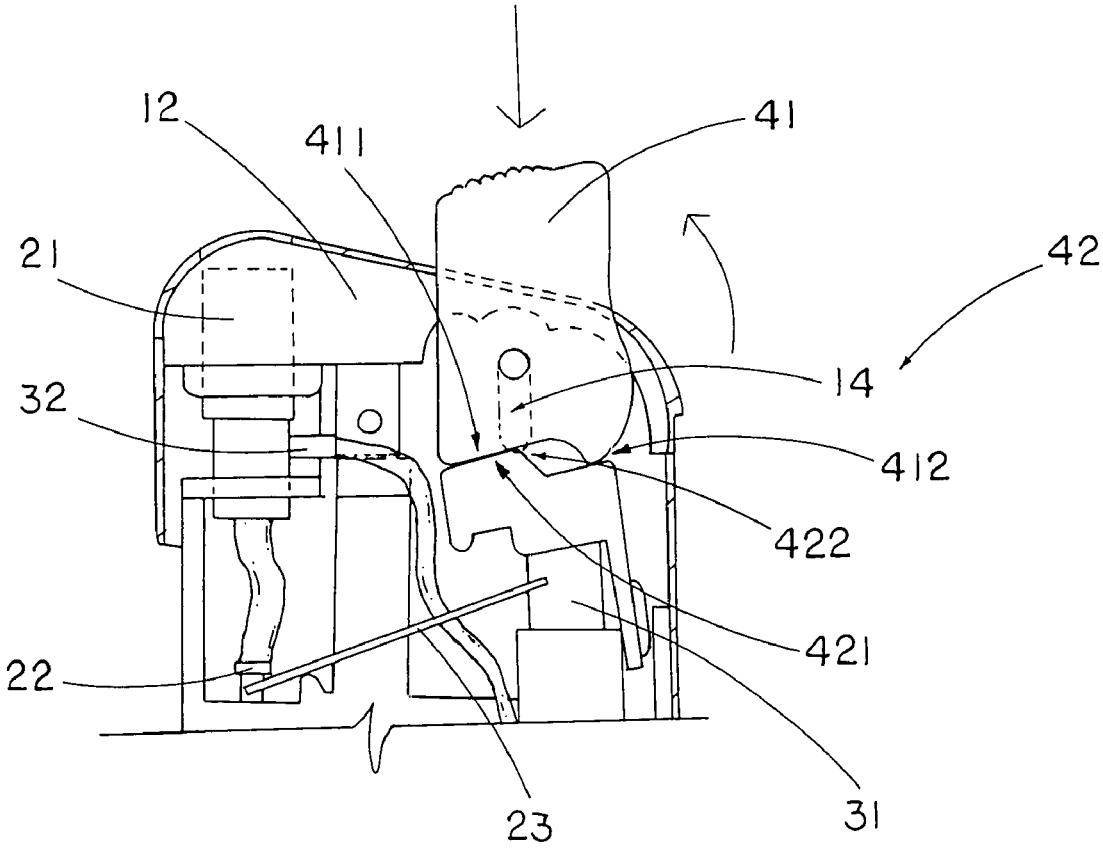
FIG. 3 is a partially sectional view of the numeral lighter according to the above preferred embodiment of the present invention.

As shown in FIGS. 2 and 3, the inner lighter housing 10 further has two guiding slots 14 formed at two sidewalls respectively wherein the ignition button 41 is pivotally connected between the two sidewalls of the inner lighter housing 10 at the guiding slots 14 and is arranged when the ignition button 41 upwardly and pivotally fold between the two sidewalls of the inner lighter housing 10, a bottom side of the ignition button 41 is sat on a top side of the depressing arm 42 such that the ignition button 41 is depressed downwardly along the guiding slots 14 to drive the depressing arm 42 downwardly to ignite the numeral lighter. In other words, the ignition operation of the numeral lighter requires two operating actions, i.e. upwardly fold the ignition button 41 and downwardly depress the ignition button 41, in order to ignite the numeral lighter so as to prevent the numeral lighter from being ignited accidentally or unintentionally.

In order to enhance the safety feature of the numeral lighter, the ignition button 41 has a flat biasing surface 411 provided on the bottom side thereof and a stepping edge 412 extended from the flat biasing surface 411, wherein the depressing arm 42 has a flat depressing surface 421 provided on the top side thereof and a corresponding stepping rim 422 extended from the flat depressing surface 421 such that the ignition button 41 is upwardly and pivotally folded until the stepping edge 412 of the ignition button 41 slidably passes the stepping rim 422 of the depressing arm 42 to engage the flat biasing surface 411 of the ignition button 41 with the flat depressing surface 421 of the depressing arm 41 so as to allow the ignition button 41 to be depressed downwardly to drive the depressing arm 42 downwardly for ignition, as shown in FIG. 3.

Accordingly, the numeral outer casing 50 is shaped as a number from 0 to 9. The user is able to have two or more numeral outer casings 50 wherein each of the numeral outer casings 50 is a universal shell to fit the inner lighter housing 10 therein such that the user is able to interchange the numeral outer casings 50 from one numeral character to another numeral character, especially the user wants to carry the numeral lighter with a lucky number with him or her. In addition, when the numeral outer casing 50 is eventually worn out over a period of continuous use, the user is able to replace the numeral outer casing 50 to protect the inner lighter housing 10 as a bare bone of the lighter so as to prolong the service life span of the numeral lighter. As shown in FIG. 1, the numeral outer casing 50 is shaped as a number of 3 or 8.

Figure 4:
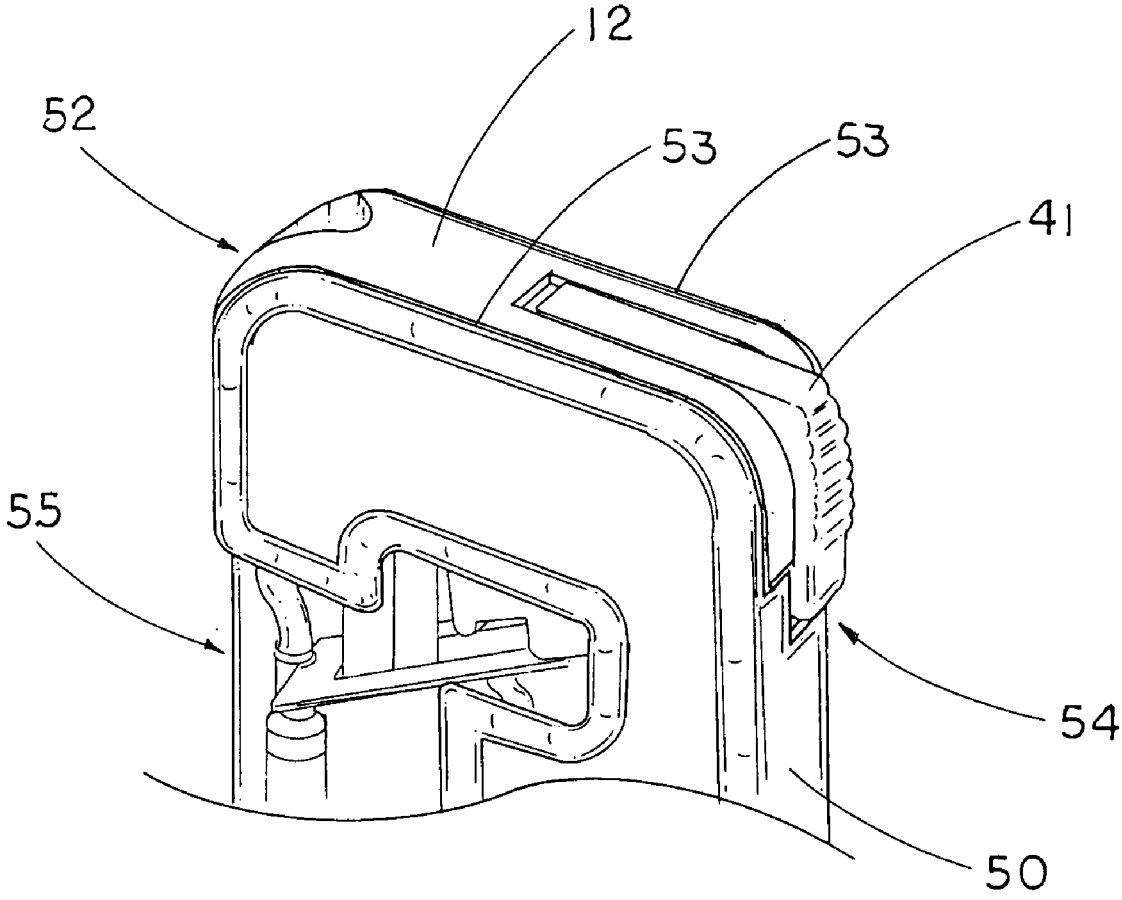
FIG. 4 illustrates the numeral outer casing of the numeral lighter with the safety feature according to the above preferred embodiment of the present invention.

As shown in FIG. 4, the numeral outer casing 50 has two top edging rims 53 defining at the top opening 52 wherein when the inner lighter housing 10 is detachably received in the receiving cavity 51 of the numeral outer casing 50, the two top edging rims 53 are aligned with a top ceiling of the top supporting frame 12 so as to fittingly accommodate the inner lighter housing 10 in the numeral outer casing 50.

The numeral outer casing 50 further has a blocking edge 54 formed at a position when the inner lighter housing 10 is received in the numeral outer casing 50, a portion of the ignition button 41 is alignedly on top of the blocking edge 54 for blocking the ignition button 41 from being depressed downwardly. As it is mentioned above, the ignition button 41 must upwardly and pivotally fold to rest on the depressing arm 42 and then the ignition button 41 is downwardly and slidably depressed to ignite the numeral lighter. However, the ignition button 41 may accidentally be forced to depress downward to depress the depressing arm 42 and may cause an unintentional ignition of the numeral lighter. Therefore, when the inner lighter housing 10 is received in the numeral outer casing 50, the ignition button 41 is blocked by the blocking edge 54 of the numeral outer casing 50 to block any downward movement of the ignition button 41 so as to further prevent the numeral lighter from being ignited accidentally or unintentionally.

As shown in FIG. 1, the numeral outer casing 50 further has a gas window 55 allowing the liquefied gas storage 11 to be seen through the gas window 55 when the inner lighter housing 10 is received in the numeral outer casing 50. Therefore, the user is able to observe the volume of gas in the liquefied gas storage 11 through the gas window 55 without detaching the inner lighter housing 10 from the numeral outer casing 50.

The numeral outer casing 50 further has a valve opening 56 formed at a bottom side to align with the refilling valve 13 when the inner lighter housing 10 is received in the numeral outer casing 50 such that the user is able to refill the gas through the refilling valve 13 without detaching the inner lighter housing 10 from the numeral outer casing 50. In addition, two attachment holes 57 are formed on the bottom wall of the inner lighter housing 10 and the bottom side of the numeral outer casing 50 wherein when the inner lighter housing 10 is received in the numeral outer casing 50, the two attachment holes 57 are aligned with each other such that a mounting element 58, such as a screw, is adapted to securely mount the inner lighter housing 10 in the numeral outer casing 50 through the attachment holes 57.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A numeral lighter, comprising:

an inner lighter housing having a liquefied gas storage and comprising a top supporting frame;

a gas nozzle received in said inner lighter housing at said top supporting frame and communicating with said liquefied gas storage for controlling a flow of gas therefrom;

a piezoelectric unit, which is disposed in said inner lighter housing for generating piezoelectricity, comprising a movable operating part extended upwardly and an ignition tip extended to a position closed to said gas nozzle in such a manner that when said movable operating part is depressed downwardly, sparks are generated from said ignition tip to ignite said gas emitted from said gas nozzle;

an ignition unit slidably mounted to said top supporting frame of said inner lighter housing to depress said movable operating part of said piezoelectric unit and to release said gas from said liquefied gas storage at the same time; and a numeral outer casing having a receiving cavity and a top opening communicating with said receiving cavity, wherein said inner lighter housing is detachably received in said receiving cavity of said numeral outer casing at a position that said liquefied gas storage is protectively enclosed within said numeral outer casing while said top supporting frame is positioned at said top opening of said numeral outer casing such that said numeral outer casing forms as an interchangeable shell to accommodate said inner lighter housing therein so as to enhance an aesthetic appearance of said lighter, wherein said ignition unit comprises an ignition button pivotally mounted on said inner lighter casing at said top supporting frame thereof and a depressing arm supported in said inner lighter casing to rest on top of said movable operating part of said piezoelectric unit and arranged in such a manner that when said ignition button is upwardly and pivotally folded to rest on top of said depressing arm, said ignition button is depressed downwardly to depress said depressing arm for ignition, wherein said inner lighter housing further has two guiding slots formed at two sidewalls respectively, wherein said ignition button is pivotally connected between said two sidewalls of said inner lighter housing at said guiding slots and is arranged when said ignition button upwardly and pivotally fold between said two sidewalls of said inner lighter housing, a bottom side of said ignition button is sat on a top side of said depressing arm such that said ignition button is depressed downwardly along said guiding slots to drive said depressing arm downwardly for ignition, and wherein said ignition button has a flat biasing surface provided on said bottom side thereof and a stepping edge extended from said flat biasing surface, wherein said depressing arm has a flat depressing surface provided on said top side thereof and a corresponding stepping rim extended from said flat depressing surface such that said ignition button is upwardly and pivotally folded until said stepping edge of said ignition button slidably passes said stepping rim of said depressing arm to engage said flat biasing surface of said ignition button with said flat depressing surface of said depressing arm so as to allow said ignition button to be depressed downwardly to drive said depressing arm downwardly for ignition.

2. A numeral lighter, comprising:

an inner lighter housing having a liquefied gas storage and comprising a top supporting frame;

a gas nozzle received in said inner lighter housing at said top supporting frame and communicating with said liquefied gas storage for controlling a flow of gas therefrom;

a piezoelectric unit, which is disposed in said inner lighter housing for generating piezoelectricity, comprising a movable operating part extended upwardly and an ignition tip extended to a position closed to said gas nozzle in such a manner that when said movable operating part is depressed downwardly, sparks are generated from said ignition tip to ignite said gas emitted from said gas nozzle;

an ignition unit slidably mounted to said top supporting frame of said inner lighter housing to depress said movable operating part of said piezoelectric unit and to release said gas from said liquefied gas storage at the same time; and a numeral outer casing having a receiving cavity and a top opening communicating with said receiving cavity, wherein said inner lighter housing is detachably received in said receiving cavity of said numeral outer casing at a position that said liquefied gas storage is protectively enclosed within said numeral outer casing while said top supporting frame is positioned at said top opening of said numeral outer casing such that said numeral outer casing forms as an interchangeable shell to accommodate said inner lighter housing therein so as to enhance an aesthetic appearance of said lighter, wherein said numeral outer casing is shaped as a number from 0 to 9, wherein said ignition unit comprises an ignition button pivotally mounted on said inner lighter casing at said top supporting frame thereof and a depressing arm supported in said inner lighter casing to rest on top of said movable operating part of said piezoelectric unit and arranged in such a manner that when said ignition button is upwardly and pivotally folded to rest on top of said depressing arm, said ignition button is depressed downwardly to depress said depressing arm for ignition, wherein said inner lighter housing further has two guiding slots formed at two sidewalls respectively, wherein said ignition button is pivotally connected between said two sidewalls of said inner lighter housing at said guiding slots and is arranged when said ignition button upwardly and pivotally fold between said two sidewalls of said inner lighter housing, a bottom side of said ignition button is sat on a top side of said depressing arm such that said ignition button is depressed downwardly along said guiding slots to drive said depressing arm downwardly for ignition, and wherein said ignition button has a flat biasing surface provided on said bottom side thereof and a stepping edge extended from said flat biasing surface, wherein said depressing arm has a flat depressing surface provided on said top side thereof and a corresponding stepping rim extended from said flat depressing surface such that said ignition button is upwardly and pivotally folded until said stepping edge of said ignition button slidably passes said stepping rim of said depressing arm to engage said flat biasing surface of said ignition button with said flat depressing surface of said depressing arm so as to allow said ignition button to be depressed downwardly to drive said depressing arm downwardly for ignition.

3. The numeral lighter, as recited in claim 2, wherein said numeral outer casing has two top edging rims defining at said top opening, wherein when said inner lighter housing is detachably received in said receiving cavity of said numeral outer casing, said two top edging rims are aligned with a top ceiling of said top supporting frame so as to fittingly accommodate said inner lighter housing in said numeral outer casing.

4. The numeral lighter, as recited in claim 2, wherein said numeral outer casing further has a blocking edge formed at a position when said inner lighter housing is received in said numeral outer casing, a portion of said ignition button is alignedly on top of said blocking edge for blocking said ignition button from being depressed downwardly.

5. The numeral lighter, as recited in claim 4, wherein said numeral outer casing further has a gas window allowing said liquefied gas storage to be seen through said gas window when said inner lighter housing is received in said numeral outer casing.

6. The numeral lighter, as recited in claim 4, wherein said inner lighter housing further comprises a refilling valve is formed at a bottom wall of said inner lighter housing to communicate with said liquefied fuel storage for refilling said gas thereto, wherein said numeral outer casing further has a valve opening formed at a bottom side to align with said refilling valve when said inner lighter housing is received in said numeral outer casing such that said gas is adapted to be refilled when said inner lighter housing is received in said numeral outer casing.

7. The numeral lighter, as recited in claim 4, wherein said numeral outer casing has two top edging rims defining at said top opening, wherein when said inner lighter housing is detachably received in said receiving cavity of said numeral outer casing, said two top edging rims are aligned with a top ceiling of said top supporting frame so as to fittingly accommodate said inner lighter housing in said numeral outer casing.

8. The numeral lighter, as recited in claim 7, wherein said inner lighter housing further comprises a refilling valve is formed at a bottom wall of said inner lighter housing to communicate with said liquefied fuel storage for refilling said gas thereto, wherein said numeral outer casing further has a valve opening formed at a bottom side to align with said refilling valve when said inner lighter housing is received in said numeral outer casing such that said gas is adapted to be refilled when said inner lighter housing is received in said numeral outer casing.

9. The numeral lighter, as recited in claim 7, wherein said numeral outer casing further has a gas window allowing said liquefied gas storage to be seen through said gas window when said inner lighter housing is received in said numeral outer casing.

10. The numeral lighter, as recited in claim 9, wherein said inner lighter housing further comprises a refilling valve is formed at a bottom wall of said inner lighter housing to communicate with said liquefied fuel storage for refilling said gas thereto, wherein said numeral outer casing further has a valve opening formed at a bottom side to align with said refilling valve when said inner lighter housing is received in said numeral outer casing such that said gas is adapted to be refilled when said inner lighter housing is received in said numeral outer casing.

* * * * *